US008401455B2

(12) United States Patent
Suh

(10) Patent No.: US 8,401,455 B2
(45) Date of Patent: Mar. 19, 2013

(54) SPACE EFFICIENT MULTI-SHEET BUFFER MODULE AND MODULAR PRINTING SYSTEM

(75) Inventor: Eun Suk Suh, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 991 days.

(21) Appl. No.: 12/413,876

(22) Filed: Mar. 30, 2009

(65) Prior Publication Data

US 2010/0247194 A1 Sep. 30, 2010

(51) Int. Cl.
*G03G 15/00* (2006.01)
*B65H 39/10* (2006.01)

(52) U.S. Cl. ..... 399/382; 271/302; 271/298

(58) Field of Classification Search ..... 399/382; 271/302, 298; 270/58.1, 58.3, 12–15, 58.01, 270/58.06; 358/1.12
See application file for complete search history.

(56) References Cited

U.S. PATENT DOCUMENTS

| | | | | |
|---|---|---|---|---|
| 6,107,579 | A | 8/2000 | Kinnemann | |
| 6,161,828 | A | 12/2000 | Sussmeier | |
| 6,450,711 | B1 | 9/2002 | Conrow | |
| 6,612,566 | B2 | 9/2003 | Stoll | |
| 7,093,831 | B2 | 8/2006 | Biegelsen et al. | |
| 7,305,200 | B2 | 12/2007 | Hoffman et al. | |
| 7,330,677 | B2 | 2/2008 | Ogura | |
| 7,426,043 | B2 | 9/2008 | Folkins et al. | |
| 7,549,723 | B2 | 6/2009 | Mihara et al. | |
| 7,680,448 | B2 * | 3/2010 | Mandel et al. | 399/381 |
| 7,706,737 | B2 | 4/2010 | Lang | |
| 7,746,524 | B2 | 6/2010 | Lofthus et al. | |
| 7,912,416 | B2 | 3/2011 | Mandel et al. | |
| 7,946,582 | B2 | 5/2011 | Suh | |
| 7,963,518 | B2 | 6/2011 | Moore | |
| 7,992,854 | B2 * | 8/2011 | Mandel et al. | 270/58.01 |
| 8,068,252 | B2 * | 11/2011 | Lange et al. | 358/1.4 |
| 2006/0033771 | A1 * | 2/2006 | Lofthus | 347/40 |
| 2006/0221159 | A1 * | 10/2006 | Moore et al. | 347/101 |
| 2006/0222384 | A1 * | 10/2006 | Moore et al. | 399/38 |
| 2006/0268317 | A1 * | 11/2006 | Lofthus et al. | 358/1.15 |
| 2006/0291018 | A1 * | 12/2006 | Lang et al. | 358/540 |
| 2007/0120305 | A1 * | 5/2007 | Mandel et al. | 270/1.01 |
| 2007/0120934 | A1 | 5/2007 | Lang | |
| 2008/0073837 | A1 | 3/2008 | Degruchy | |

(Continued)

OTHER PUBLICATIONS

Suh et al., U.S. Appl. No. 12/413,802, Office Action Communication, Oct. 26, 2010, 10 pages.

(Continued)

*Primary Examiner* — Matthew G Marini
*Assistant Examiner* — Allister Primo
(74) *Attorney, Agent, or Firm* — Gibb & Riley, LLC

(57) ABSTRACT

Disclosed are a sheet buffer module and a printing system incorporating the buffer module. The buffer module has parallel first and second sheet transport paths that extend in opposite directions across a frame. Sheet buffer paths connect the first sheet transport path to the second sheet transport path. In operation, a stream of sheets is fed by the first sheet transport path from a multi-color printing module to a monochrome printing module. During this process, selected sheets are diverted from the stream into the sheet buffer paths and held. After processing by the monochrome printing module, the stream is fed by the second sheet transport path back to the multi-color printing module for further processing and/or final output. During this process, the sheet buffer paths feed the buffered sheets into the second sheet transport path such that they are inserted at the proper locations back into the stream.

21 Claims, 3 Drawing Sheets

U.S. PATENT DOCUMENTS

2008/0196606 A1* 8/2008 Lang ..... 101/2

OTHER PUBLICATIONS

Suh et al., U.S. Appl. No. 12/413,923, Office Action Communication, Jul. 29, 2011, 11 pages.
Bober et al., U.S. Appl. No. 12/211,852, filed Sep. 17, 2008.
Bober et al., U.S. Appl. No. 12/211,853, filed Sep. 17, 2008.
Mandel et al., U.S. Appl. No. 12/331,768, filed Dec. 10, 2008.
Suh et al., U.S. Appl. No. 12/413,802, Notice of Allowance, Apr. 4, 2011, 7 pages.
EP Patent Office Communication Dated Jan. 7, 2013, EP Patent No. 10158095.9-1256/2236447 pp. 1-6.

* cited by examiner

SPACE EFFICIENT MULTI-SHEET BUFFER MODULE AND MODULAR PRINTING SYSTEM

BACKGROUND AND SUMMARY

This application is related to the following applications filed concurrently herewith by the same Applicants and assigned to the same Assignee: U.S. Pat. No. 7,946,582, Issued May 24, 2011 and U.S. Pat. No. 8,128,088, Issued Mar. 6, 2012. The complete disclosures of these co-pending applications are incorporated in their entirety herein by reference.

Embodiments herein generally relate to modular printing systems and, more particularly, to embodiments of a multi-sheet buffer module and a modular printing system incorporating such a multi-sheet buffer module.

Modularity in printing systems is known. For example, U.S. patent application Ser. No. 12/211,853 of Bober et al., filed on Sep. 17, 2008, and U.S. patent application Ser. No. 12/331,768 of Mandel et al., filed on Dec. 10, 2008 (both of which are assigned to Xerox Corporation of Norwalk, Conn., USA, and incorporated herein by reference in their entirety) disclose electrostatographic printing systems comprising multiple modules (i.e., discrete interchangeable units). Each module comprises one or more of the printing system's functional components (e.g., sheet feeders, printing engines, sheet inverters, sheet buffers, finishers, etc.) structurally self-contained within its own supporting frame and housing (i.e., cabinet).

Oftentimes multi-page documents contain both single color (i.e., monochrome) pages and multi-color pages. Since it is more cost and time efficient to print single color pages using a single color (i.e., monochrome) printing engine vice a multi-color printing engine, modular printing systems incorporating heterogeneous printing engine modules (e.g., a single color and multi-color printing engine modules) in a tightly integrated parallel printing (TIPP) architecture have been developed (e.g., see U.S. patent application Ser. No. 12/211,853 of Bober et al. and U.S. patent application Ser. No. 12/331,768 of Mandel et al., incorporated by reference above). Such modular printing systems can print multi-page documents, having single color and multi-color pages. To ensure that the various single color and multi-color pages are printed on print media sheets by the appropriate printing engine(s), a sorting process is performed. Once printed, the single color and multi-color pages are merged in order to output the finished document. However, timing of sheet output from the different print engines to ensure proper page merging (i.e., to ensure that pages are in the proper order) presents a problem for a number of reasons. For example, since multi-color print engines are typically more costly to run and since multi-page documents typically have significantly more text-only pages than multi-color pages, it is more cost efficient to print all or batches of multi-color pages together. This minimizes the number of on-off and warm-up cycles performed by the multi-color printing engine during a single print job, but results in multi-color pages being printed out of order and, particularly, early. Timing of sheet output is further made difficult as a result of duplex printing and mixed printing (i.e., when a single sheet requires printing by one side by a single color printing engine and on the opposite side by a multi-color printing engine).

In view of the foregoing, disclosed herein are embodiments of a multi-sheet buffer module and a modular printing system incorporating the multi-sheet buffer module. The buffer module has parallel first and second sheet transport paths that extend in opposite directions (i.e., transport sheets in opposite directions) across a support frame. Multiple parallel sheet buffer paths extend from the first sheet transport path to the second sheet transport path. In operation, a stream of sheets (e.g., unimaged sheets, sheets previously printed in simplex or duplex format by the first printing module, etc.) is received by the first sheet transport path from a first printing module (e.g., a color printing module) and fed through to a second printing module (e.g., a single color printing module). During this process, selected sheets are diverted from the stream into the sheet buffer paths and held. After processing by the second printing module (e.g., simplex or duplex printing), the stream of sheets is received by the second sheet transport path and fed through to the first printing module for further processing and/or for final output, for example, to a finishing module. During this process, the sheet buffer paths will feed the buffered sheets into the second sheet transport path such that they are inserted at the proper locations back into the stream of sheets. Such a multi-sheet buffer module provides a buffering function, as necessary, during the various printing processes (e.g., single color printing in simplex or duplex format, multi-color printing in simplex or duplex format, and mixed printing (i.e., one side single color, one side multi-color)) performed by the different printing modules and further provides a buffering function to ensure that sheets fully printed by the different printing modules are merged in the proper order prior to output.

Generally, embodiments of a multi-sheet buffer module as disclosed herein can comprise a support frame having a first side and a second side opposite the first side. A first sheet transport path can extend across the support frame for transporting sheets in a given direction from a first sheet input port on the first side to a first sheet output port on the second side. Additionally, a second sheet transport path, which is parallel to the first sheet transport path, can extend across the support frame for transporting sheets in the opposite direction from a second sheet input port on the second side to a second sheet output port on the first side. Finally, a plurality of sheet buffer paths can extend between the first and second sheet transport paths for transporting sheets from the first sheet transport path to the second sheet transport path and each of the sheet buffer paths can have a length sufficient to hold one or more print media sheets.

The multi-sheet buffer module, as described generally above, can be configured (as shown) for insertion between two stacked printing modules in a modular printing system. For example, in such an embodiment the support frame can have a bottom side and a top side opposite the bottom side. The first sheet transport path can extend essentially vertically across the support frame for transporting sheets in an upward direction from a first sheet input port on the bottom side of the support frame to a first sheet output port on the top side of the support frame. Additionally, a second sheet transport path, which is parallel to the first sheet transport path, can extend essentially vertically across the support frame for transporting sheets in a downward direction from a second sheet input port on the top side of the support frame to a second sheet output port on the bottom side of the support frame. Finally, a plurality of sheet buffer paths can extend essentially horizontally between the first and second sheet transport paths for transporting sheets from the first sheet transport path to the second sheet transport path.

During operation of the multi-sheet buffer module, the first sheet transport path can receive, at the first input port, a stream of sheets and can feed the stream of sheets out the first sheet output port. During this process, at least one sheet buffer path can divert at least one selected sheet from the stream and can hold that selected sheet. Subsequently, the second sheet transport path can receive, at the second input port, the stream of sheets and can feed the stream out the second sheet output port. During this process, any sheet buffer paths holding selected sheets can feed the selected sheets into the second sheet transport path such that they inserted back into the stream at predetermined points. To accomplish this, the buffer module can comprise a controller operatively connected to the first sheet transport path and the sheet buffer paths so as to control movement of sheets within the buffer module. Specifically, each sheet buffer path can have a corresponding gate adjacent to the first sheet transport path and one or more sheet transport devices. Each gate can be selectively controlled (e.g., by the controller) to force selected sheets to enter the sheet buffer paths on demand. Additionally, the sheet transport device(s) in each buffer path can be selectively controlled (e.g., by the controller) to force selected sheets, which are being held, to exit into the second sheet transport path on demand.

The above-described multi-sheet buffer module embodiments can be incorporated into a modular printing system with multiple printing modules in order to arrange sheets within a multi-page document in the proper order prior to output. The multi-sheet buffer module embodiments provide the additional advantage of allowing for sheet buffering during the various printing processes performed by the different printing modules. Specifically, such a modular printing system can comprise a first printing module (e.g., a multiple color printing module), and a second printing module (e.g., a single color printing module). The first printing module and the second printing module in this modular printing system can, for example, operate in tandem to print a multi-page document having single color sheets in simplex or duplex form, multiple color sheets in simplex or duplex form and, optionally, mixed sheets (i.e., sheets with single color printing one side and multi-color printing on the opposite side of the sheet). The multi-sheet buffer module, as described in detail above, can be positioned between the first printing module and the second printing module. For example, in the case of stacked printing modules, the buffer module can be positioned on top of the first printing module and below the second printing module. In this configuration, the multi-sheet buffer can provide any required sheet buffering during the various printing operations performed by the first and second printing modules and can also provide sheet buffering to arrange fully printed sheets within a multi-page document in the proper order prior to output.

During operation of the modular printing system, the first printing module (e.g., the color printing module) can receive unimaged sheets from, for example, a feeder module. Once in the first printing module, some of the sheets can be processed (i.e., can be printed in simplex and/or duplex form by the first printing module) and all sheets (i.e., any unimaged sheets and any printed sheets) can be forwarded in a stream to the buffer module. In the buffer module, the first sheet transport path can receive the stream of sheets at the first input port from the first printing module and can begin feeding this stream of sheets out the first sheet output port into the second printing module (e.g., into the single color printing module). During this process, at least one sheet buffer path can divert at least one selected sheet from the stream and can hold that selected sheet such that the sheet is not passed into the second printing module for processing. Once in the second printing module, the remaining sheets in the stream can be processed (i.e., can be printed in simplex and/or duplex form by the second printing module). Subsequently, the second sheet transport path can receive the stream of sheets at the second input port from the second printing module, as processed by the second printing module, and can begin feeding the stream out the second sheet output port back into the first printing module. During this process, any sheet buffer paths holding selected sheets (i.e., buffered sheets) can feed the selected sheets into the second sheet transport path such that they are inserted back into the stream at a predetermined point. Once back in the first printing module, individual sheets within the stream may be further processed by the first printing module, transported back into the buffering module for further processing as described above and/or finally output, for example, to a finishing module.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 1:
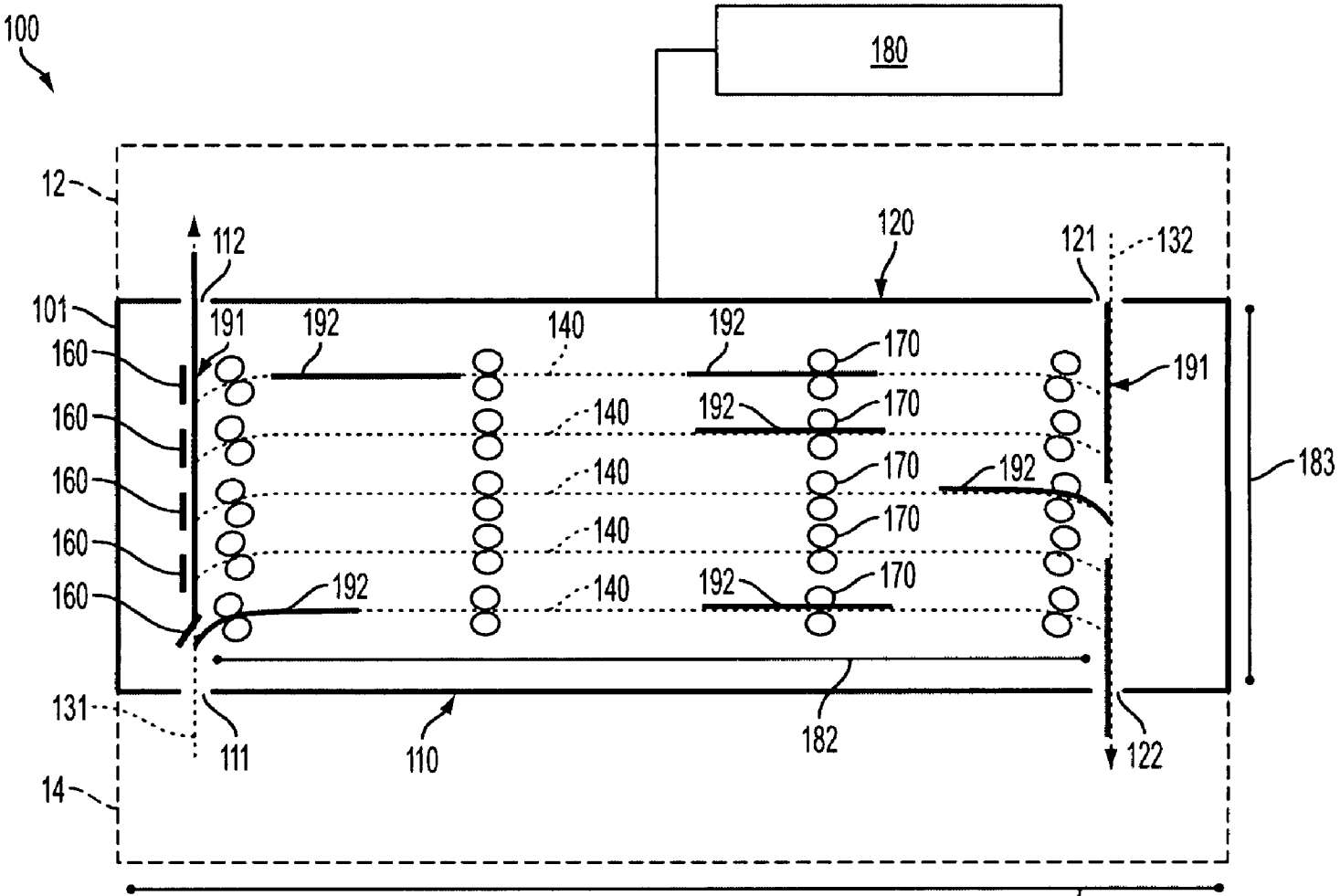
FIG. 1 is a schematic diagram of an embodiment of a multi-sheet buffer module.

As mentioned above, modularity in printing systems is known. For example, U.S. patent application Ser. No. 12/211,853 of Bober et al., filed on Sep. 17, 2008, and U.S. patent application Ser. No. 12/331,768 of Mandel et al., filed on Dec. 10, 2008 (both of which are assigned to Xerox Corporation of Norwalk, Conn., USA, and incorporated herein by reference in their entirety) disclose electrostatographic printing systems comprising multiple modules (i.e., discrete interchangeable units). Each module comprises one or more of the printing system's functional components (e.g., sheet feeders, printing engines, sheet inverters, sheet buffers, finishers, etc.) structurally self-contained within its own supporting frame and housing (i.e., cabinet).

Oftentimes multi-page documents contain both single color (i.e., monochrome) pages (e.g., text-only pages) and multi-color pages (e.g., pages with colored graphics and/or images only and pages with a combination of text and colored graphics and/or images). Since it is more cost and time efficient to print single color pages using a single color (i.e., monochrome) printing engine vice a multi-color printing engine, modular printing systems incorporating heterogeneous printing engine modules (e.g., a single color and multi-color printing engine modules) in a tightly integrated parallel printing (TIPP) architecture have been developed (e.g., see U.S. patent application Ser. No. 12/211,853 of Bober et al. and U.S. patent application Ser. No. 12/331,768 of Mandel et al., incorporated by reference above). Such modular printing systems can print multi-page documents, having single color and multi-color pages. To ensure that the various single color and multi-color pages are printed on print media sheets by the appropriate printing engine(s), a sorting process is performed. Once printed, the single color and multi-color pages are merged in order to output the finished document. However, timing of sheet output from the different print engines to ensure proper page merging (i.e., in order to ensure the pages are in the proper order) presents a problem for a number of reasons. For example, since multi-color print engines are typically more costly to run and since multi-page documents typically have significantly more text-only pages than multi-color pages, it is more cost efficient to print all or batches of multi-color pages together. This minimizes the number of on-off and warm-up cycles performed by the multi-color printing engine during a single print job, but results in multi-color pages being printed out of order and, particularly, early. Timing of sheet output is further made difficult as a result of duplex printing and mixed printing (i.e., when a single sheet requires printing on one side by the single color printing engine and on the other side by the multi-color printing engine).

One solution to this problem is to provide a multi-sheet buffer module which receives a merged stream of sheets output by the multiple printing engines, such as the multi-sheet buffer module disclosed in the co-pending patent application "DOUBLE EFFICIENCY SHEET BUFFER MODULE AND MODULAR PRINTING SYSTEM WITH DOUBLE EFFICIENCY SHEET BUFFER MODULE" Ser. No. 12/413,802, incorporated by reference above. Such a buffer module can be configured to divert, into sheet buffer paths, any sheets which have been printed out of order and, particularly, early, to hold those sheets, and to subsequently insert those sheets back into the stream at the proper time. Thus, the pages in the printed document as output from the buffer module and, for example, forwarded to a finishing module, are in the proper order. The Double Efficiency Sheet Buffer Module, however, has the disadvantage of taking up additional floor space, where a space constraint exists.

In view of the foregoing, disclosed herein are embodiments of a multi-sheet buffer module and a modular printing system incorporating the multi-sheet buffer module. The buffer module has parallel first and second sheet transport paths that extend in opposite directions (i.e., transport sheets in opposite directions) across a support frame. Multiple parallel sheet buffer paths extend from the first sheet transport path to the second sheet transport path. In operation, a stream of sheets (e.g., unimaged sheets, sheets previously printed in simplex or duplex format by the first printing module, sheets previously printed in simplex form by the second printing module, etc.) is received by the first sheet transport path from a first printing module (e.g., a color printing module) and fed through to a second printing module (e.g., a single color printing module). During this process, selected sheets are diverted from the stream into the sheet buffer paths and held. After processing by the second printing module (e.g., simplex or duplex printing), the stream of sheets is received by the second sheet transport path and fed through to the first printing module for further processing and/or for final output, for example, to a finishing module. During this process, the sheet buffer paths will feed the buffered sheets into the second sheet transport path such that they are inserted at the proper locations back into the stream of sheets. Such a multi-sheet buffer module provides a buffering function, as necessary, during the various printing processes (e.g., single color printing in simplex or duplex format, multi-color printing in simplex or duplex format, and mixed printing (i.e., one side single color, one side multi-color)) performed by the different printing modules and further provides a buffering function to ensure that sheets printed by the different printing modules are merged in the proper order prior to output.

Referring to FIG. 1, generally, embodiments of a multi-sheet buffer module 100 as disclosed herein can comprise a support frame 101 having a first side 110 and a second side 120 opposite the first side 110. A first sheet transport path 131 can extend across the support frame 101 for transporting sheets in a given direction from a first sheet input port 111 on the first side 110 to a first sheet output port 112 on the second side 120. Additionally, a second sheet transport path 132, which is parallel to the first sheet transport path 131, can extend across the support frame 101 for transporting sheets in the opposite direction from a second sheet input port 121 on the second side 120 to a second sheet output port 122 on the first side 110. Finally, a plurality of sheet buffer paths 140 extend between the first and second sheet transport paths 131, 132 for transporting sheets from the first sheet transport path 131 to the second sheet transport path 132. The first sheet transport path 131, the second sheet transport path 132 and the buffer paths 140, can each comprise sheet transport devices 170 (e.g., as nip apparatuses (as shown) and/or transport belts) that are configured (e.g., with a drive roller) to cause print media sheets entering the path to be transported in a specific direction.

The multi-sheet buffer module 100, as described generally above, can be configured (as shown) for insertion between two stacked printing modules (i.e., printers) 14, 12 in a modular printing system, having a "tower" TIPP architecture. For example, in such an embodiment the support frame 101 can have a bottom side 110 and a top side 120 opposite the bottom side 110. The first sheet transport path 131 can extend essentially vertically across the support frame 101 for transporting sheets in an upward direction from a first sheet input port 111 on the bottom side 110 of the support frame 101 to a first sheet output port 112 on the top side 120 of the support frame 101. Additionally, a second sheet transport path 132, which is parallel to the first sheet transport path 131, can extend essentially vertically across the support frame 101 for transporting sheets in a downward direction from a second sheet input port 121 on the top side 120 of the support frame 101 to a second sheet output port 122 on the bottom side 110 of the support frame 101. Finally, a plurality of sheet buffer paths 140 can extend essentially horizontally between the first and second sheet transport paths 131, 132 for transporting sheets from the first sheet transport path 131 to the second sheet transport path 132. This particular embodiment has the advantage of providing a buffer module without increasing the footprint and, thereby the floor area required, for a printing system. However, those skilled in the art will recognize that the multi-sheet buffer module, as described generally above, can also be configured for insertion laterally between non-stacked printing modules.

Regardless of whether the sheet buffer module 100 is configured to be stacked or not, the buffer module 100 can be configured with any number of sheet buffer paths 140 (e.g., 5 as shown, 10, 20, 30, 50, etc.) and each of these sheet buffer paths 140 can have a length sufficient to hold one or more print media sheets. However, those skilled in the art will recognize that the number of sheet buffer paths 140 and the length of the sheet buffer paths 140 are limited by the dimensions of the buffer module 100. That is, if the sheet buffer module 100 is configured to be stacked between printing modules 14, 12, then the allowable height (e.g., as determined by customer specifications) for the sheet buffer module will dictate the total number of sheet buffer paths that can be incorporated into the sheet buffer module 100. For example, if each sheet buffer path 140, including sheet transport devices 170, requires approximately 2-3 inches of space and if the maximum height 183 of the sheet buffer module 100 is set at 18 inches, then the sheet buffer module 100 may be configured with approximately 6-9 sheet buffer paths 140. Furthermore, if the length of the sheet buffer module 100 is approximately equal to the length 181 of the printing modules 14, 12 (e.g., between 30 and 50 inches), then the sheet buffer paths 140 can be configured to have a length 182 that is only slightly less. Thus, allowing more than one sheet to be buffered in each sheet buffer path 140 at a time.

During operation of the multi-sheet buffer module 100, the first sheet transport path 131 can receive, at the first input port 111, a stream 191 of sheets and can feed (i.e., can be configured to or adapted to feed) the stream 191 of sheets out the first sheet output port 112. During this process, at least one sheet buffer path 140 can divert (i.e., can be configured to or adapted to divert) at least one selected sheet 192 from the stream 191 and can hold that selected sheet 192. Subsequently, the second sheet transport path 132 can receive, at the second input port 121, the stream 191 of sheets and can feed the stream 191 out the second sheet output port 122. During this process, any sheet buffer path 140 holding selected sheets 192 can feed (i.e., can be configured to or adapted to feed) the selected sheets 192 into the second sheet transport path 132 such that they are inserted back into the stream 191 at predetermined points.

To accomplish this, the buffer module 100 can comprise a controller 180 operatively connected to the first sheet transport path 131 and the sheet buffer paths 140 so as to control movement of sheets within the buffer module 100. Specifically, the controller 180 can access, from an internal or external data storage device, information indicating the proper flow of sheets between the printing modules during printing, indicating the proper order in which printed sheets in the stream 191 are to be in prior to final output and also indicating the actual order of the sheets within the stream 191. Based on this information, the controller 180 can determine (i.e., can be configured to or adapted to determine) which sheets require buffering (e.g., either during the various printing processes performed by the different printing modules 14, 12 or to ensure that sheets printed by the different printing modules are merged in the proper order prior to output), can select (i.e., can be configured to or adapted to select) those sheets, and can cause (i.e., can be configured to or adapted to cause) the buffer module 100 to perform the required buffering. Those skilled in the art will recognize that controller 180 can be programmed with computer usable program code and can further comprise a processor adapted to execute the code in order to perform these functions.

More particularly, based on an analysis of information pertaining to the proper flow of sheets between the printing modules 14, 12 during printing, the proper order in which printed sheets in the stream 191 are to be in prior to final output and the actual order of the sheets within the stream 191, the controller 180 can cause gates 160 to divert, into the sheet buffer paths 140, one or more selected sheets 192 from the stream 191 as it passes through the first sheet transport path 131. Subsequently, the controller 180 can cause sheet transport device(s) 170 within the sheet buffer paths 140 to insert those selected sheets 192 back into the stream 191 as it passes through the second sheet transport path 132 at the proper moment.

Specifically, each sheet buffer path 140 can have a corresponding gate 160 adjacent to the first sheet transport path 131. Each gate 160 can be positioned at the intersection between the first sheet transport path 131 and its corresponding sheet buffer path 140. Actuation of each gate 160 can be selectively controlled (e.g., by the controller 180) to either allow sheets to pass along the first sheet transport path 131 directly to the first sheet output port 112 or to force sheets to divert into (i.e., enter into) the corresponding sheet buffer path 140 on demand. For example, each gate 160 can be configured as a baffle or diverter capable of pivoting movement in order to control the direction a sheet travels (i.e., along the first sheet transport path 131 or into a corresponding sheet buffer path 140). The pivoting movement of each gate 160 can be individually and automatically controlled by the controller 180.

Additionally, each sheet buffer path 140 can further have one or more sheet transport devices 170 positioned so as to ensure that any sheet held within a sheet buffer path 140 can be engaged and transported to the second sheet transport path 132. Actuation of individual sheet transport devices 170 (e.g., nips, as shown, or electrostatic transport belts) within the sheet buffer paths 140 can be selectively controlled (e.g., by the controller 180) to allow any one specific sheet 192 to maintain its position within a specific sheet buffer path 140 or to force any one specific sheet 192 being held within a specific sheet buffer path 140 to exit the sheet buffer path 140 and thereby, enter the second sheet transport path 132 on demand. For example, each sheet transport device 170 can be configured with a conventional drive roller, which rotates so as to directly (e.g., in the case of nips) or indirectly (e.g., in the case of transport belts) cause a sheet to move in a given direction. Rotation of each drive roller can be controlled by a motor, which in turn can be individually and automatically by the controller 180.

The above-described multi-sheet buffer module 100 embodiments can be incorporated into any modular printing system with multiple printing modules that requires or that would benefit from sheet buffering during printing and/or in order to output a multi-page document with all pages in the proper order. For example, the multi-sheet buffer module 100, described in detail above, can be incorporated into a modular printing system such as that disclosed in U.S. patent application Ser. No. 12/211,853 of Bober et al. (incorporated by reference above).

Figure 2:
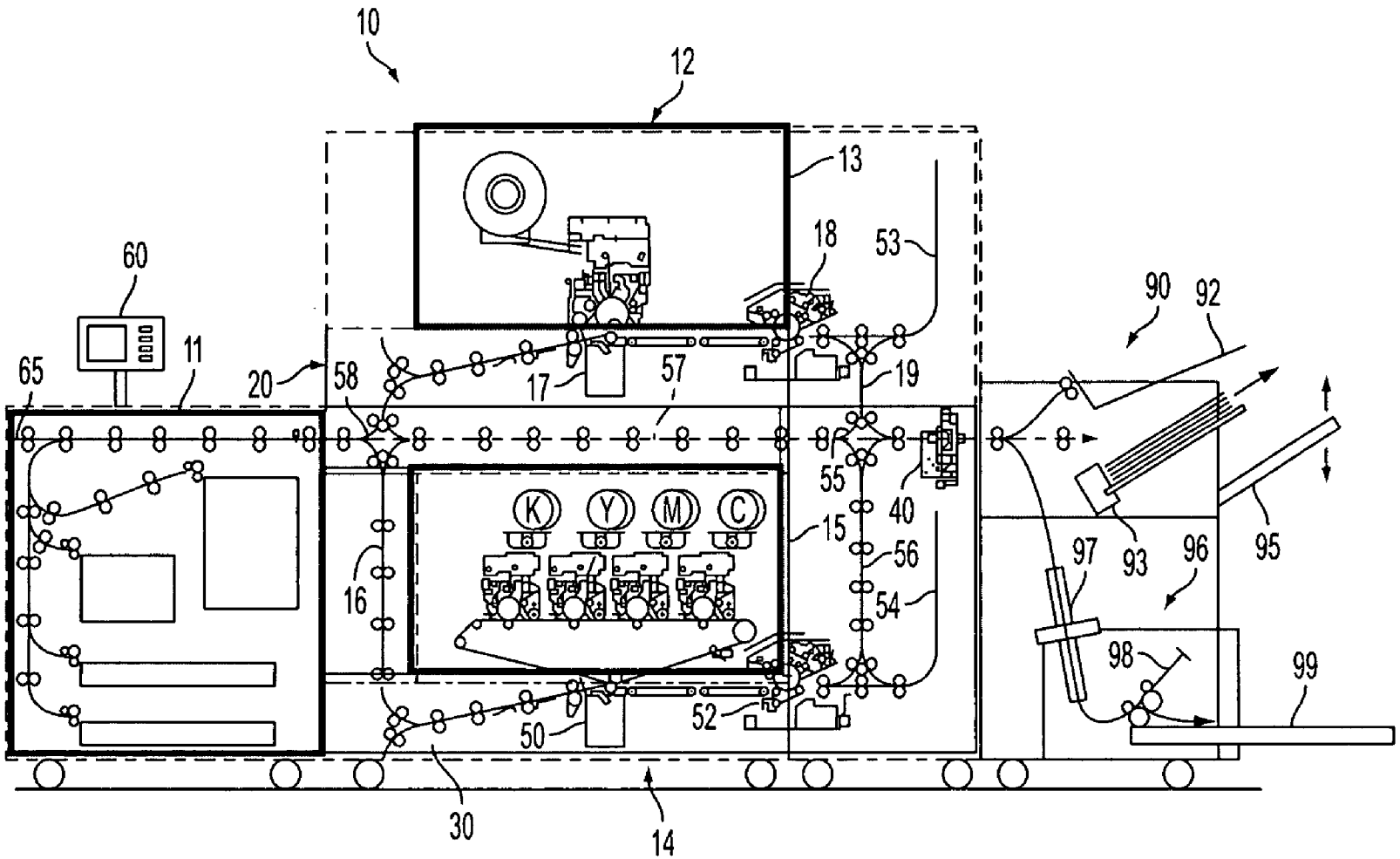
FIG. 2 is a schematic diagram of a modular printing system having multiple printing modules.

Specifically, FIG. 2 provides an illustration of a modular printing system 10 as disclosed in U.S. patent application Ser. No. 12/211,853 of Bober et al. (incorporated by reference above), having a "tower" TIPP architecture. This modular printing system 10 provides for single color printing in simplex or duplex format, multi-color printing in simplex or duplex format, and mixed printing (i.e., one side single color, one side multi-color). This modular printing system 10 outputs a merged stream of single color sheets in simplex or duplex format, multi-color sheets in simplex or duplex format, and, optionally, mixed sheets (i.e., one side single color, one side multi-color) into a finisher module 90 and would benefit from the incorporation of a multi-sheet buffer module capable of re-ordering sheets from the merged stream, as necessary, prior to processing by the finisher module 90. The modular printing system 10 comprises a sheet feed module 11, electronic printers 12 and 14 (i.e., printing modules) that include a conventional monochrome marking engine module 13 and a conventional color image marking engine module (IME) 15, respectively, and a paper transport path leading into and out of each printer that includes media path modules 20 and 30 connecting these three modules and associated for tightly integrated parallel printing of documents with the system. Finished output from the printing system is sent to a conventional finisher 90.

For simplex monochrome copies, feeder module 11 includes a plurality of conventional sheet feeders that feed sheets into a media path highway 57 and into a conventional diverter gate system 58 that conveys the sheets into upper media path module 20 and on to transfer station 17 to have images from IME 13 transferred thereto. The sheets are then transported through fuser 18 and into inverter 53 where the sheet is inverter for proper face down output collation exiting to the vertical path 19, through a diverter gate system 55, decurler 40 and into finisher 90. Alternatingly, unimaged sheets from sheet feed module 11 are fed downward through the diverter gate system 58 into vertical transport 16 and through lower media path module 30 to transfer station 50 to receive images from IME 15. The sheets are then transported through fuser 52, into inverter 54 for proper face down output collation, exiting into vertical transport 56, through diverter gate system 55 and through decurler 40 en route to conventional finisher 90 accepts unstapled sheets in upper catch tray 92 or stapled sheet at 93 in intermediate catch tray 95 or sheets stapled at 97 in booklet maker 96 and folded into booklets at folder 98 and outputted onto lower catch tray 99. Control station 60 allows an operator to selectively control the details of a desired job. Optionally, an insert or interposed sheet, such as, a cover, photo, tab sheet or other special sheet can be inserted into the first printer engine from an auxiliary sheet feed source (not shown) through sheet input 65, if desired.

For color image duplexing, sheets can be fed from feeder module 11 through diverter system 58, into color electronic printer 14 and downward along vertical transport 16 to lower media path module 30 and on to transfer station 50 to receive images on a first side thereof from IME 15 that includes cyan, magenta, yellow and black developer housings. Afterwards, the sheets are forwarded through fuser 52 and into inverter 54. The sheets leave inverter 54 trail edge first and are fed upwards along media transport path 56 and into media path highway 57, through diverter gate systems 55 and 58 and eventually downward along vertical transport 16 and back to lower media path module 30 and again through transfer station 50 to receive images onto a second side of the sheets. The sheets are then fused at fuser 52 and transported upward along media path 56, through diverter gate system 55 and out through decurler 40 and into finisher 90. For monochrome image duplexing, sheets can be fed from feeder module 11 through diverter gate system 58, into monochrome electronic printer 12 and into the media path module 20 and on to transfer station 17 to receive monochrome images on a first side thereof from IME 13 that includes a black developer housing only. Afterwards, the sheets are forwarded through fuser 18 and into inverter 53. The sheets leave inverter 53 trail edge first and are fed downwards along media transport path 19, through diverter gate system 55 and into media path highway 57, through diverter gate system 58 and back to upper media path module 20 and again through transfer station 17 to receive monochrome images onto a second side of the sheets. The sheets are then fused at fuser 18 and transported downward along media path 19, through diverter gate system 55 and out through decurler 40 and into finisher 90. Or alternatingly, combinations of one side monochrome and one side color imaged duplexed sheets can be produced by using these same media path elements in the appropriate sequences.

Figure 3:
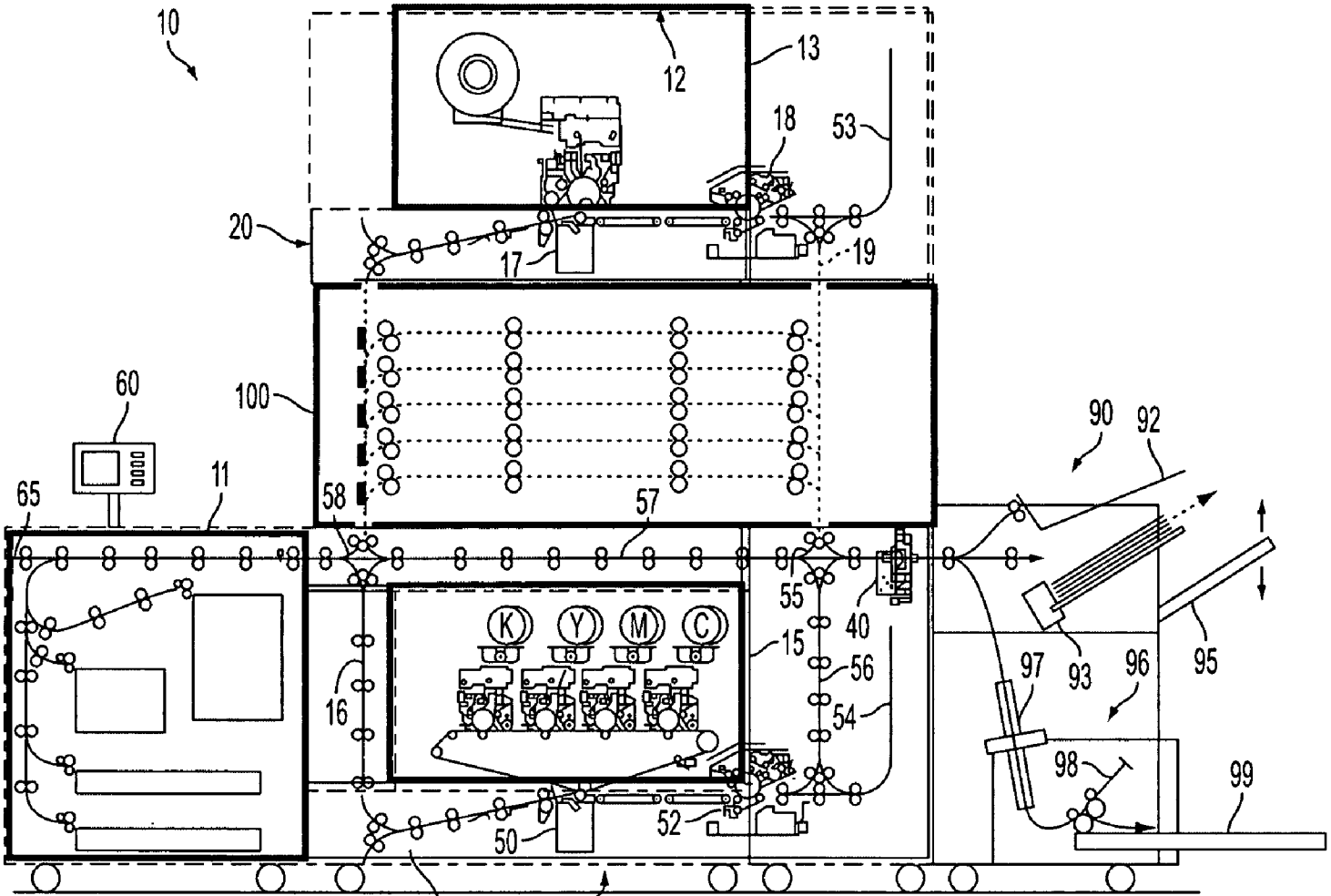
FIG. 3 is a schematic diagram of an embodiment of a modular printing system, such as the modular printing system of FIG. 2, incorporating a multi-sheet buffer module, such as the multi-sheet buffer module of FIG. 1.

Referring to FIG. 3 in combination with FIG. 1, the multi-sheet buffer module 100 of FIG. 1 can easily be incorporated into the modular printing system 10 of FIG. 2 or any other similar stacked or unstacked modular printing system which provides for single color printing in simplex or duplex format, multi-color printing in simplex or duplex format and, optionally, mixed printing (i.e., one side single color, one side multi-color). Specifically, such a modular printing system 10 can comprise a first printing module 14 and a second printing module 12. The first printing module 14 can, for example, comprise a multiple color printing module configured with a multiple color printing engine 15. The second printing module 30 can, for example, comprise a single color (i.e., monochrome) printing module configured with a single color printing engine 13. Various sheet transport paths and, optional, inverters can extend between and through the printing engine modules 14, 12, as described above.

The first printing module 14 and the second printing module 12 in this modular printing system 10 can, for example, operate in tandem (i.e., can be adapted to or configured to operate in tandem) to print a multi-page document having single color sheets in simplex or duplex format, multiple color sheets in simplex or duplex format, and, optionally, mixed sheets (i.e., one side single color, one side mixed color). The multi-sheet buffer module 100, as described in detail above, can be positioned between the first printing module 14 and the second printing module 12. For example, in the case of stacked printing modules (i.e., a tower TIPP architecture), the buffer module 100 can be positioned on top of the first printing module 14 and below the second printing module 12. In this configuration, the multi-sheet buffer 100 can provide any required sheet buffering during the various printing operations performed by the first and second printing modules 14, 12 and can also provide sheet buffering to arrange sheets within a multi-page document in the proper order prior to output.

During operation of the modular printing system 10, the first printing module 14 (e.g., the color printing module) can receive unimaged sheets (i.e., blank sheets) from, for example, a feeder module 11. Once in the first printing module 14, some of the sheets can be processed (i.e., can be printed in simplex and/or duplex form by the first printing module 14), as discussed above, and all sheets (i.e., any unimaged sheets and any printed sheets) can be forwarded in a stream 191 to the buffer module 100.

In the buffer module 100, the first sheet transport path 131 can receive the stream 191 of sheets at the first input port 111 from the first printing module 14 and can beginning feeding this stream 191 of sheets out the first sheet output port 112 into the second printing module 120 (e.g., into the single color printing module). During this process, at least one sheet buffer path 140 can divert at least one selected sheet 192 from the stream 191 and can hold that selected sheet such that the sheet 192 is not passed into the second printing module 12 for processing.

Once in the second printing module 12, the remaining sheets in the stream 191 can be processed (i.e., can be printed in simplex and/or duplex form by the second printing module 14). Subsequently, the second sheet transport path 132 can receive the stream 191 of sheets at the second input port 121 from the second printing module 12, as processed by the second printing module 12, and can begin feeding the stream 191 out the second sheet output port 122 back into the first printing module 14. During this process, any sheet buffer paths 140 holding selected sheets 192 (i.e., buffered sheets) can feed the selected sheets 192 into the second sheet transport path 132 such that they are inserted back into the stream 191 at a predetermined point. Once back in the first printing module 14, individual sheets within the stream 191 may be further processed by the first printing module 14 (e.g., to allow for mixed printing when one side of a sheet is to be printed using a single color and another side of the same sheet is to be printed using multiple colors), transported back into the buffering module prior to additional processing (e.g., to allow for efficient scheduling during mixed printing) and/or finally output, for example, to a finishing module 90. Thus, the disclosed printing system 10 allows sheets from both the first and second printing modules 14, 12 to access the buffer module 10, as necessary, before final output.

It should be understood that the controller 180 described above and illustrated in FIG. 1 can be integrated into the control station 60 of the modular printing system 10 of FIG.

3. The control station 60 can preferably comprise a programmable, self-contained, dedicated mini-computer having a central processor unit (CPU), electronic storage, and a display or user interface (UI) and can function as the main control system for the multiple modules (e.g., the feeder module, printing engine modules, sheet buffer module, etc.) within the modular printing system 10.

It should further be understood that the terms "image printing device", "printing device", "printing engines", "printing machine", "printer", "printing system", etc., as used herein encompass any of a digital copier, bookmaking machine, facsimile machine, multi-function machine, etc. which performs a print outputting function. The details of printing devices (e.g., printers, printing engines, etc.) are well-known by those ordinarily skilled in the art. Printing devices are readily available devices produced by manufactures such as Xerox Corporation, Norwalk, Conn., USA. Such printing devices commonly include input/output, power supplies, processors, media movement devices, marking devices etc., the details of which are omitted herefrom to allow the reader to focus on the salient aspects of the embodiments described herein. Additionally, the term "print medium" as used herein encompasses any cut sheet or roll of print media suitable for receiving images, pictures, figures, drawings, printed text, handwritten text, etc. Exemplary print media include, but are not limited to, a paper, plastic, and vinyl. Finally, the phrase "stream of sheets" as used herein refers to print media sheets transported in succession (i.e., one after another) through a sheet transport path.

It should further be understood that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein should not be implied or imported from any above example as limitations to any particular order, number, position, size, shape, angle, color, or material.

Therefore, disclosed above are embodiments of a multi-sheet buffer module and a modular printing system incorporating the multi-sheet buffer module. The buffer module has parallel first and second sheet transport paths that extend in opposite directions (i.e., transport sheets in opposite directions) across a support frame. Multiple parallel sheet buffer paths extend from the first sheet transport path to the second sheet transport path. In operation, a stream of sheets (e.g., unimaged sheets, sheets previously printed in simplex or duplex format by the first printing module, sheets previously printed in simplex form by the second printing module, etc.) is received by the first sheet transport path from a first printing module (e.g., a color printing module) and fed through to a second printing module (e.g., a single color printing module). During this process, selected sheets are diverted from the stream into the sheet buffer paths and held. After processing by the second printing module (e.g., simplex or duplex printing), the stream of sheets is received by the second sheet transport path and fed through to the first printing module for further processing and/or for final output, for example, to a finishing module. During this process, the sheet buffer paths will feed the buffered sheets into the second sheet transport path such that they are inserted at the proper locations back into the stream of sheets. Such a multi-sheet buffer module provides a buffering function, as necessary, during the various printing processes (e.g., single color printing in simplex or duplex format, multi-color printing in simplex or duplex format, and mixed printing (i.e., one side single color, one side multi-color)) performed by the different printing modules and further provides a buffering function to ensure that sheets printed by the different printing modules are merged in the proper order prior to output. In a "tower" TIPP modular printing system architecture, such a sheet buffer modules, provides the added advantage of not increasing the overall footprint of the printing system.

What is claimed is:

1. A multi-sheet buffer module comprising:

a frame having a first side and a second side opposite said first side;

a first sheet transport path extending linearly across said frame from a first sheet input port on said first side to a first sheet output port on said second side;

a second sheet transport path parallel to said first sheet transport path, said second sheet transport path extending linearly across said frame from a second sheet input port on said second side to a second sheet output port on said first side;

a plurality of sheet buffer paths extending between said first sheet transport path and said second sheet transport path, said sheet buffer paths all being one-way paths for transporting sheets from said first sheet transport path to said second sheet transport path, said first sheet transport path receiving, at said first input port, a first stream of sheets and feeding said first stream of sheets out said first sheet output port into a printing module, said printing module processing said first stream of sheets and outputting a second stream of sheets to said second sheet input port and into said second sheet transport path; and a controller operatively connected to sheet transport devices on said first sheet transport path and said sheet buffer paths and further operatively connected to gates between said first sheet transport path and said sheet buffer paths, said controller controlling said sheet transport devices and said gates so as to cause a selected sheet to be diverted from said first stream of sheets to a sheet buffer path, said controller controlling said sheet transport devices so as to cause said selected sheet to move from said sheet buffer path into said second stream of sheets, said second stream of sheets moving along said second sheet transport path from said second sheet input port to said second sheet output port, and said controller further controlling said sheet transport devices so as to ensure that said selected sheet is held in said sheet buffer path an amount of time before moving from said sheet buffer path into said second sheet transport path such that said selected sheet is inserted into said second stream of sheets at a predetermined point within said second stream of sheets in order to achieve a predetermined sheet order as said second stream of sheets passes through said second sheet output port.

2. The buffer module of claim 1, during said feeding of said first stream out said first sheet output port by said first sheet transport path, said selected sheet being diverted from said first stream into said sheet buffer path such that said selected sheet is not processed by said printing module and said selected sheet further being held in said sheet buffer path for said amount of time, said second sheet transport path receiving, from said printing module at said second input port, said second stream of sheets and feeding said second stream out said second sheet output port, and during said feeding of said second stream out said second sheet output port by said second sheet transport path, said selected sheet being fed from said sheet buffer path into said second sheet transport path such that said selected sheet is inserted into said second stream at said predetermined point.

3. The buffer module of claim 1, each sheet buffer path having a corresponding gate adjacent said first sheet transport path, said gate being selectively controllable by said controller to force said selected sheet to enter said sheet buffer path on demand.

4. The buffer module of claim 1, each sheet buffer path comprising at least one sheet transport device, said at least one sheet transport device being selectively controllable by said controller to force said selected sheet to exit said sheet buffer path into said second sheet transport path on demand such that said selected sheet is inserted into said second stream at said predetermined point.

5. The buffer module of claim 1, each sheet buffer path having a length sufficient to hold multiple print media sheets.

6. A multi-sheet buffer module comprising:

a frame having a bottom side and a top side opposite said bottom side;

a first sheet transport path extending essentially vertically across said frame from a first sheet input port on said bottom side to a first sheet output port on said top side;

a second sheet transport path parallel to said first sheet transport path, said second sheet transport path extending essentially vertically across said frame from a second sheet input port on said top side to a second sheet output port on said bottom side;

a plurality of sheet buffer paths extending essentially horizontally between said first sheet transport path and said second sheet transport path, said sheet buffer paths all being one-way paths for transporting sheets from said first sheet transport path to said second sheet transport path, said first sheet transport path receiving, at said first input port, a first stream of sheets and feeding said first stream of sheets out said first sheet output port into a printing module, said printing module processing said first stream of sheets and outputting a second stream of sheets to said second sheet input port and into said second sheet transport path; and a controller operatively connected to sheet transport devices on said first sheet transport path and said sheet buffer paths and further operatively connected to gates between said first sheet transport path and said sheet buffer paths, said controller controlling said sheet transport devices and said gates so as to cause a selected sheet to be diverted from said first stream of sheets to a sheet buffer path, said controller controlling said sheet transport devices so as to cause said selected sheet to move from said sheet buffer path into said second stream of sheets, said second stream of sheets moving along said second sheet transport path from said second sheet input port to said second sheet output port, and said controller further controlling said sheet transport devices so as to ensure that said selected sheet is held in said sheet buffer path an amount of time before moving from said sheet buffer path into said second sheet transport path such that said selected sheet is inserted into said second stream of sheets at a predetermined point within said second stream of sheets in order to achieve a predetermined sheet order as said second stream of sheets passes through said second sheet output port.

7. The buffer module of claim 6, during said feeding of said first stream out said first sheet output port by said first sheet transport path, said selected sheet being diverted from said first stream into said sheet buffer path such that said selected sheet is not processed by said printing module and said selected sheet further being held in said sheet buffer path for said amount of time, said second sheet transport path receiving, from said printing module at said second input port, said second stream of sheets and feeding said second stream out said second sheet output port, and during said feeding of said second stream out said second sheet output port by said second sheet transport path, said selected sheet being fed from said sheet buffer path into said second sheet transport path such that said selected sheet is inserted into said second stream at said predetermined point.

8. The buffer module of claim 6, each sheet buffer path having a corresponding gate adjacent said first sheet transport path, said gate being selectively controllable by said controller to force said selected sheet to enter said sheet buffer path on demand.

9. The buffer module of claim 6, each sheet buffer path comprising at least one sheet transport device, said at least one sheet transport device being selectively controllable by said controller to force said selected sheet to exit said sheet buffer path into said second sheet transport path on demand such that said selected sheet is inserted into said second stream at said predetermined point.

10. The buffer module of claim 6, each sheet buffer path having a length sufficient to hold multiple print media sheets.

11. A printing system comprising:

a first printing module;

a second printing module; and a multi-sheet buffer module between said first printing module and said second printing module, said buffer module comprising:

a frame having a first side adjacent said first printing module and a second side opposite said first side and adjacent said second printing module;

a first sheet transport path extending linearly across said frame from a first sheet input port on said first side to a first sheet output port on said second side;

a second sheet transport path parallel to said first sheet transport path, said second sheet transport path extending linearly across said frame from a second sheet input port on said second side to a second sheet output port on said first side; and a plurality of sheet buffer paths extending between said first sheet transport path and said second sheet transport path, said sheet buffer paths all being one-way paths for transporting sheets from said first sheet transport path to said second sheet transport path, said first sheet transport path receiving, at said first sheet input port from said first printing module, a first stream of sheets and feeding said first stream of sheets out said first sheet output port into said second printing module, said second printing module processing said first stream of sheets and outputting a second stream of sheets to said second sheet input port and into said second sheet transport path; and a controller operatively connected to sheet transport devices on said first sheet transport path and said sheet buffer paths and further operatively connected to gates between said first sheet transport path and said sheet buffer paths, said controller controlling said sheet transport devices and said gates so as to cause a selected sheet to be diverted from said first stream of sheets to a sheet buffer path, said controller controlling said sheet transport devices so as to cause said selected sheet to move from said sheet buffer path into said second stream of sheets, said second stream of sheets moving along said second sheet transport path from said second printing module at said second sheet input port to said first printing module at said second sheet output port, and said controller further controlling said sheet transport devices so as to ensure that said selected sheet is held in said sheet buffer path an amount of time before moving from said sheet buffer path into said second sheet transport path such that said selected sheet is inserted into said second stream of sheets at a predetermined point within said second stream of sheets in order to achieve a predetermined sheet order as said second stream of sheets passes through said second sheet output port.

12. The printing system of claim 11, said first printing module comprising a multi-color printing module and said second printing module comprising a single color printing module.

13. The printing system of claim 11, each sheet buffer path having a corresponding gate adjacent said first sheet transport path, said gate being selectively controllable by said controller to force selected to enter said sheet buffer path from said first sheet transport path on demand.

14. The printing system of claim 11, each sheet buffer path comprising at least one sheet transport device, said at least one sheet transport device being selectively controllable by said controller to force said selected sheet to exit said sheet buffer path into said second sheet transport path on demand such that said selected sheet is inserted into said second stream at said predetermined point.

15. The printing system of claim 11, each sheet buffer path having a length sufficient to hold multiple print media sheets.

16. The printing system of claim 11, said first printing module and said second printing module operating in tandem to print a multi-page document having single color sheets in one of simplex format and duplex format, multiple color sheets in one of simplex format and duplex format, and, optionally, mixed sheets with one side being single color and an opposite side being multi-color.

17. A printing system comprising:

a first printing module;

a second printing module stacked above said first printing module; and a multi-sheet buffer module between said first printing module and said second printing module, said buffer module comprising:

a frame having a bottom side adjacent said first printing module and a top side adjacent said second printing module;

a first sheet transport path extending essentially vertically across said frame from a first sheet input port on said bottom side to a first sheet output port on said top side;

a second sheet transport path parallel to said first sheet transport path, said second sheet transport path extending essentially vertically across said frame from a second sheet input port on said top side to a second sheet output port on said bottom side; and a plurality of sheet buffer paths extending essentially horizontally between said first sheet transport path and said second sheet transport path, said sheet buffer paths all being one-way paths for transporting sheets from said first sheet transport path to said second sheet transport path, said first sheet transport path receiving, at said first sheet input port from said first printing module, a first stream of sheets and feeding said first stream of sheets out said first sheet output port into said second printing module, said second printing module processing said first stream of sheets and outputting a second stream of sheets to said second sheet input port and into said second sheet transport path; and a controller operatively connected to sheet transport devices on said first sheet transport path and said sheet buffer paths and further operatively connected to gates between said first sheet transport path and said sheet buffer paths, said controller controlling said sheet transport devices and said gates so as to cause a selected sheet to be diverted from said first stream of sheets to a sheet buffer path, said controller controlling said sheet transport devices so as to cause said selected sheet to move from said sheet buffer path into said second stream of sheets, said second stream of sheets moving along said second sheet transport path from said second printing module at said second sheet input port to said first printing module at said second sheet output port, and said controller further controlling said sheet transport devices so as to ensure that said selected sheet is held in said sheet buffer path an amount of time before moving from said sheet buffer path into said second sheet transport path such that said selected sheet is inserted into said second stream of sheets at a predetermined point within said second stream of sheets in order to achieve a predetermined sheet order as said second stream of sheets passes through said second sheet output port.

18. The printing system of claim 17, said first printing module comprising a multi-color printing module and said second printing module comprising a single color printing module.

19. The printing system of claim 11, during said feeding of said second stream out said first sheet output port by said first sheet transport path, said selected sheet being diverted from said first stream into said sheet buffer path such that said selected sheet is not processed by said second printing module and said selected sheet being held in said sheet buffer path for said amount of time, said second sheet transport path receiving, from said second printing module at said second input port from said second printing module, said second stream of sheets and feeding said second stream out said second sheet output port into said first printing module, and during said feeding of said second stream out said second sheet output port by said second sheet transport path, said selected sheet being fed from said sheet buffer path into said second sheet transport path such that said selected sheet is inserted into said second stream at said predetermined point.

20. The printing system of claim 17, during said feeding of said second stream out said first sheet output port by said first sheet transport path, said selected sheet being diverted from said first stream into said sheet buffer path such that said selected sheet is not processed by said second printing module and said selected sheet being held in said sheet buffer path for said amount of time, said second sheet transport path receiving, from said second printing module at said second input port from said second printing module, said second stream of sheets and feeding said second stream out said second sheet output port into said first printing module, and during said feeding of said second stream out said second sheet output port by said second sheet transport path, said selected sheet being fed from said sheet buffer path into said second sheet transport path such that said selected sheet is inserted into said second stream at said predetermined point.

21. The buffer module of claim 1, said plurality of sheet buffer paths comprising at least 5 sheet buffer paths.

* * * * *